US010793405B2

(12) United States Patent
Tao et al.

(10) Patent No.: US 10,793,405 B2
(45) Date of Patent: Oct. 6, 2020

(54) SCISSOR JACKS

(71) Applicant: Ford Global Technologies LLC, Dearborn, MI (US)

(72) Inventors: Michael Tao, Nanjing (CN); Brenna Liu, Nanjing (CN); Han Zhou, Nanjing (CN); Zhuang Xu, Nanjing (CN); Wendy Ge, Nanjing (CN)

(73) Assignee: Ford Global Technologies LLC, Dearborn, MI (US)

( * ) Notice: Subject to any disclaimer, the term of this patent is extended or adjusted under 35 U.S.C. 154(b) by 95 days.

(21) Appl. No.: 16/242,490

(22) Filed: Jan. 8, 2019

(65) Prior Publication Data

US 2019/0218078 A1 Jul. 18, 2019

(30) Foreign Application Priority Data

Jan. 15, 2018 (CN) ..... 2018 1 0035491

(51) Int. Cl.
*B66F 3/12* (2006.01)
*B66F 7/28* (2006.01)

(52) U.S. Cl.
CPC . *B66F 3/12* (2013.01); *B66F 7/28* (2013.01)

(58) Field of Classification Search
CPC .... B66F 13/00; B66F 3/12; B66F 3/22; B66F 3/245; B66F 3/25; B66F 3/36; B66F 3/38
See application file for complete search history.

(56) References Cited

U.S. PATENT DOCUMENTS

| | | | | | |
|---|---|---|---|---|---|
| 2,416,796 | A * | 3/1947 | Dobbs | B60S 9/12 | 254/423 |
| 3,765,650 | A * | 10/1973 | Eisenhauer | B66F 3/38 | 254/133 R |
| 3,802,658 | A * | 4/1974 | Binding | B66F 1/04 | 248/352 |
| 4,015,825 | A | 4/1977 | Graafsma et al. | | |
| 4,848,733 | A * | 7/1989 | Yamauchi | B66F 3/12 | 254/126 |
| 5,011,119 | A * | 4/1991 | Harrington | B60D 1/66 | 254/420 |
| 5,135,201 | A * | 8/1992 | Engel | B66F 3/12 | 254/126 |
| 5,386,969 | A * | 2/1995 | Popowich | B66F 3/12 | 254/126 |
| 5,449,149 | A * | 9/1995 | Popowich | B66F 3/12 | 254/126 |

(Continued)

FOREIGN PATENT DOCUMENTS

| | | | |
|---|---|---|---|
| CN | 103663248 | B | 3/2014 |
| DE | 202004014357 | U1 | 11/2004 |
| GB | 664718 | A | 1/1952 |

*Primary Examiner* — Tyrone V Hall, Jr.
(74) *Attorney, Agent, or Firm* — Raymond L. Coppiellie; Kolitch Romano LLP

(57) ABSTRACT

A scissor jack comprises a bracket coupled to a first upper arm and a second upper arm; a load rest positioned above the bracket and pivotally connected to the bracket; an elastic element disposed between the load rest and the bracket; a base coupled to a first lower arm and a second lower arm; a first connector pivotally connected to the first upper arm and the first lower arm; a second connector pivotally connected to the second upper arm and the second lower arm; and a driving rod drivably connected to the first and second connectors.

20 Claims, 4 Drawing Sheets

(56) References Cited

U.S. PATENT DOCUMENTS

| | | | | | |
|---|---|---|---|---|---|
| 5,458,316 | A * | 10/1995 | Engel | B66F 3/12 | 254/126 |
| 5,516,066 | A * | 5/1996 | Fabiano | B66F 3/12 | 254/133 R |
| 5,697,598 | A * | 12/1997 | Fabiano | B66F 3/12 | 254/126 |
| 6,634,688 | B2 * | 10/2003 | Foat | B60R 11/06 | 224/42.4 |
| 6,920,936 | B2 | 7/2005 | Sheiretov et al. | | |
| 7,168,685 | B2 * | 1/2007 | Miner | B66F 5/00 | 254/8 B |
| 8,579,258 | B2 * | 11/2013 | Ayana | B66F 3/12 | 254/133 R |
| 9,108,830 | B2 * | 8/2015 | Arner | B66F 3/12 | |
| 10,513,422 | B2 * | 12/2019 | Cheung | B66F 3/22 | |
| 2015/0034888 | A1 | 2/2015 | Mancin et al. | | |
| 2015/0034890 | A1 * | 2/2015 | Arner | B66F 3/12 | 254/133 R |

* cited by examiner

SCISSOR JACKS

RELATED APPLICATION

This application claims the benefit of Chinese Patent Application No.: CN 201810035491.1 filed on Jan. 15, 2018, the entire contents thereof being incorporated herein by reference.

FIELD

The present application relates to a scissor jack, in particular, a scissor jack with a support that can offset a lateral force.

BACKGROUND

A vehicle is typically equipped with a jack such as a scissor jack to lift the vehicle if needed. When the jack is used to lift one side of the vehicle, the vehicle may be tilted to create a lateral displacement and impose a lateral force to the jack. US Patent application US2015/0034888A discloses a jack having a first arm and a second arm hinged to each other and a supporting member only supported by an upper end of the first arm and rotatable around an axis. The jack further comprises a spring with one end connected to the supporting member and another end connected the first arm, which maintains the supporting member parallel to the first arm when the supporting member is lowered and/or is not resting on a chassis of a vehicle. GB patent document GB664718A discloses a jack having a pair of upper links pivotally connected each other and a load engaging member tiltable relative to a pivotal axis of the upper pair of links. The jack further comprises a leaf spring interposed between the load engaging member and the upper links. Although the jacks in US2015/0034888A and GB664718A can reduce the effect of lateral force to some extents, the inventors of the present disclosure have recognized that the supporting member or the load engaging member can have issues in the stability. Thus, there is need for a jack which can reduce or eliminate the effect of the lateral force while have a stable supporting member for the loaded object.

SUMMARY

According to one aspect of the present disclosure, a scissor jack comprises a bracket pivotally connected to a first upper arm and a second upper arm; a load rest positioned above the bracket and pivotally connected to the bracket via a pivot pin; an elastic element disposed between the load rest and the bracket; a base coupled to a first lower arm and a second lower arm; a first connector pivotally connected to the first upper arm and the first lower arm; a second connector pivotally connected to the second upper arm and the second lower arm; and a driving rod drivably connected to the first and second connectors.

In one embodiment, a lengthwise direction of the pivot pin may be substantially perpendicular to a lengthwise direction of the driving rod.

In another embodiment, each of two sidewalls of the load rest may have a through hole, and each of the two sidewalls of the bracket may have a first connecting hole. The pivot pin passes through the through holes and the first connecting hole such that the load rest is pivotable via the pivot pin relative to the bracket.

In another embodiment, the Jack may further comprise a damping ring disposed between the pivot pin and the first connecting hole.

In another embodiment, each of the sidewalls of the bracket may include a second connecting hole and a third connecting hole. The first connecting hole may be disposed between the second and third connecting holes at the lengthwise direction. The bracket is pivotally connected to the first and second upper arms via a first support rivet positioned in the second connecting hole and a second support rivet positioned in the third connecting hole, respectively.

In another embodiment, a lengthwise direction of the elastic element may be substantially perpendicular to a lengthwise direction of the pivot pin.

In another embodiment, the elastic element may include two elastic members and the pivot pin may be between the two elastic elements at a lengthwise direction of the driving rod.

In another embodiment, the elastic element may be configured to bias the load rest toward an unloaded position, and a support plane of the load rest may be substantially parallel to the driving rod at the unloaded position.

In another embodiment, a lower surface of the load rest may include a first groove to receive a first end of the elastic element, and a top surface of the bracket may include a second groove to receive a second end of the elastic element. The elastic element is connected to the load rest and the bracket.

In another embodiment, the elastic element may be a coil spring.

In another embodiment, the coil spring may have an elastic coefficient in a range of 2.5 to 4.5 kN/mm.

In another embodiment, the elastic element may be a rubber rod.

In another embodiment, the base may be pivotally connected to the first lower arm via a first base rivet and pivotally connected to the second lower arm via a second base rivet.

According to another aspect, a scissor jacket comprises a pair of upper arms; a driving rod at least partially positioned between the pair of upper arms; a support, and an elastic element. The support includes a bracket pivotally connected to the pair of upper arms and a load rest disposed above the bracket to hold an object. The load rest is pivotally connected to the bracket via a pivot pin and pivoted around the pivot pin to at least partially offset a lateral force applied by the object. The elastic element is connected between the bracket and the load rest and configured to bias the load rest toward an unloaded position. The load rest has a support plane substantially parallel the driving rod at the unloaded position and contacting the object at least partially at a loaded position and.

In one embodiment, the bracket may have two sidewalls substantially perpendicular to the support plane of the load rest, and each of the sidewalls of the bracket may include a first connecting hole, a second connecting hole and a third connecting hole. The second and third connecting holes are positioned at left and right sides of the first connecting hole, respectively. The bracket is pivotally connected to the first and second upper arms respectively via a first support rivet in the second connecting hole and a second support rivet in the third connecting hole.

In another embodiment, the jack further comprises a pair of lower arms and a base pivotally connected to the pair of lower arms.

According to yet another aspect, a support of a scissor jacket comprises a bracket including sidewalls pivotally connected to a pair of upper arms of the scissor jack; a load rest, and an elastic element. The load rest is positioned above the bracket and includes a main body to support an object and sidewalls extending down from the main body. The sidewalls are pivotally connected to the sidewalls of the bracket via a pivot pin. A lengthwise direct of the pivot pin is substantially parallel to a pivot axis around which the bracket pivotable to the upper arms. One end of the elastic element is connected to a lower surface of the main body of the load rest, and another end is connected to a top surface of the bracket.

In one embodiment, the elastic element may be configured to counteract a pivotal movement of the load rest.

In another embodiment, the elastic element may be positioned above and to one side of the pivot pin.

In another embodiment, the pivot pin may be positioned between a center area of the main body of the load rest. The elastic element may include two elastic elements and the two elastic elements are positioned on left and right sides of the pivot pin at a lengthwise direction of a driving rod.

BRIEF DESCRIPTION OF THE DRAWINGS

Example embodiments will be more clearly understood from the following brief description taken in conjunction with the accompanying drawings. The accompanying drawings represent non-limiting, example embodiments as described herein.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment and should not be interpreted as defining or limiting the range of values or properties encompassed by example embodiments. The use of similar or identical reference numbers in the various drawings is intended to indicate the presence of a similar or identical element or feature.

DETAILED DESCRIPTION

The disclosed jacks will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various jacks are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
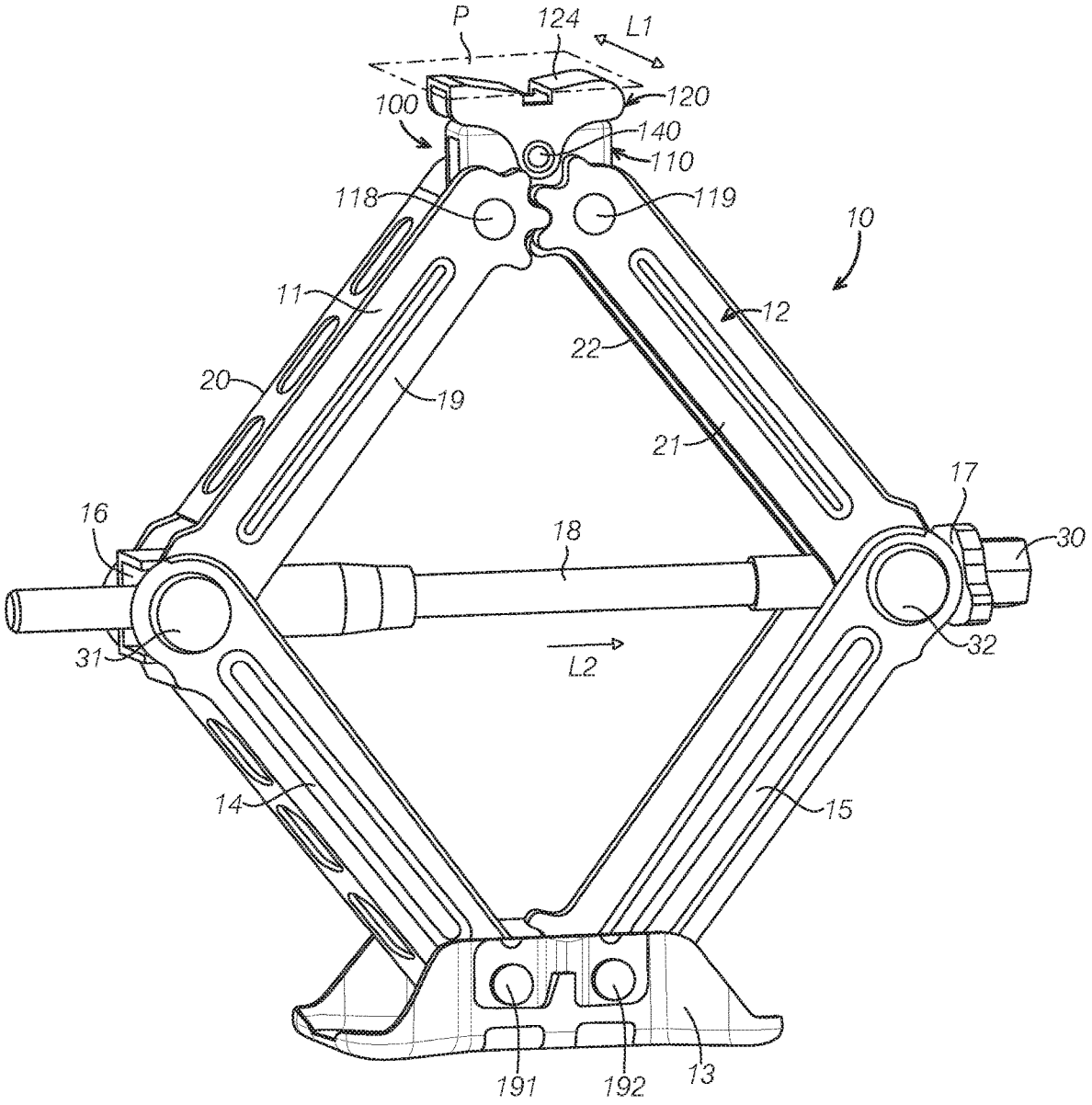
FIG. 1 schematically illustrates a scissor jack according to one or more embodiments of the present disclosure.
Figure 2A:
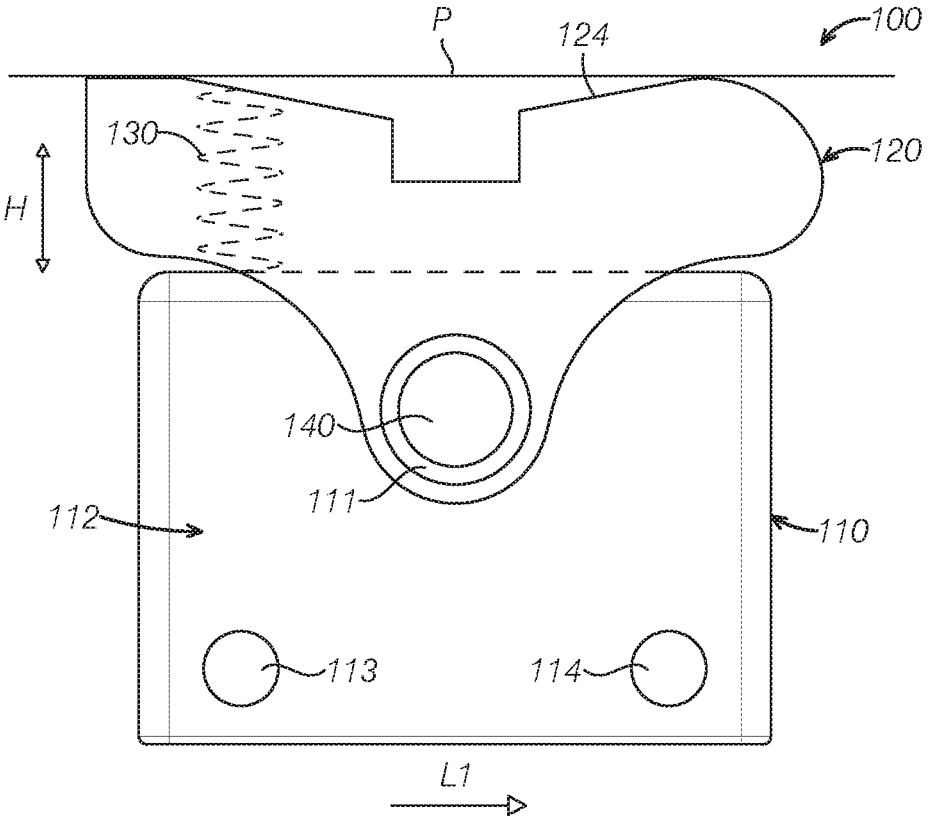
FIG. 2A is a front view of a support of the scissor jack in FIG. 1, illustrating the support at an unloaded position.
Figure 2B:
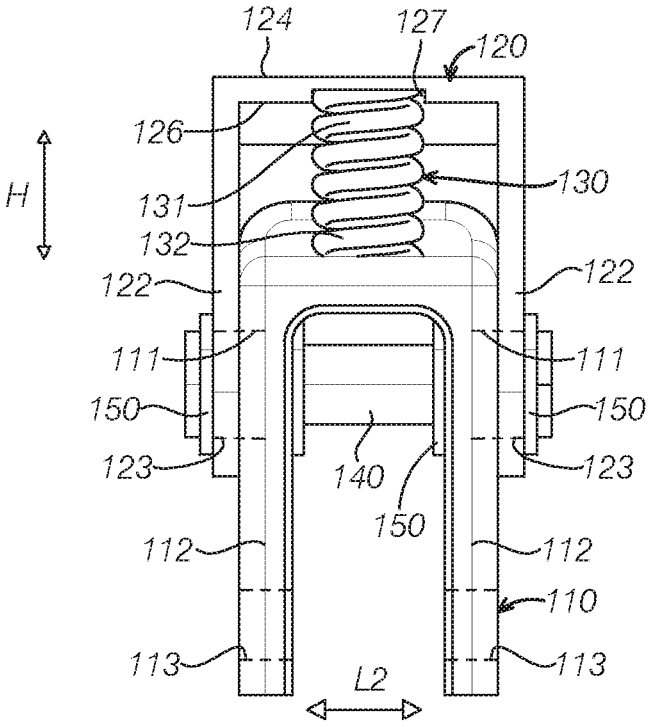
FIG. 2B is a side view of the support in FIG. 2A.

FIG. 1 to 2B schematically show a scissor jacket 10 according to one or more embodiments of the present disclosure. The scissor jacket 10 comprises a support 100 to hold a load, a first upper arm 11 and a second upper arm 12 coupled to the support 100, a base 13, a first lower arm 14 and a second lower arm 15 coupled to base 13, a first connector 16 pivotally connected to the first upper arm 11 and the first lower arm 14, a second connector 17 pivotally connected to the second upper arm 12 and the second lower arm 15, and a driving rod 18 drivably connected to the first connector 16 and the second connector 17. The support 100 includes a bracket 110 pivotally connected to the first and second upper arms 11, 12, a load rest 120 positioned above the bracket 110 and pivotally connected to the bracket 110 via a pivot pin 140, and an elastic element 130 disposed between the load rest 120 and the bracket 110 and connecting the load rest 120 and the bracket 110.

Referring to FIG. 1, in one or more embodiments, the first upper arm 11 and second upper arm 12 may be pivotably connected to the support 100. In the depicted embodiment, the first upper arm 11 and second upper arm 12 may be pivotably connected to the bracket 110 via supporting rivets 118 and 119. As known in the art, a top end of the first upper arm 104 and the second upper arm 106 may have toothed structures which are coupled each other. The top ends are further coupled with the bracket 110. Lower ends of the first lower arm 14 and the second lower arm 15 may be pivotably connect to the base 13 via the first base rivet 191 and the second base rivet 192, respectively. At the base 13, the first lower arm 14 and the second lower arm 15 may be coupled each other via toothed structures (not shown).

In addition, the first upper arm 11 and the first lower arm 14 may be pivotably connected to the first connector 16 via a pivot rod 31, respectively. The second upper arm 12 and the second lower arm 15 may be pivotably connected to the second connector 17 via a pivot rod 32, respectively. Thus, when a rotating driving tool 30 moves the first connector 16 toward the second connector 17 along the driving rod 18, the distance between the support 100 and the base 13 increases to lift the support 100, while the driving rod 18 maintains parallel with the ground. It should be appreciated that the connections of the first and second upper arms with the support 100 and the connection of the first and second lower arms with the base 13 may be achieved by any other appropriate approaches, such as pivotal connection, rotating pin connection, or convex member/concave member connection.

FIGS. 2A and 2B are a front view and a side view of the support 100, respectively. Referring to FIGS. 2A, 2B and with further reference to FIG. 1, the support 100 includes a bracket 110 and a load rest 120. The bracket 110 includes a top surface 115 and a pair of sidewalls 112 extended downward from the top surface 115. The sidewall 112 includes a first connecting hole 111, a second connecting hole 113, and a third connecting hole 114. The first upper arm 11 is pivotally connected to the sidewall 112 via the first support rivet 118 that inserts into the second connecting hole 113, and the second upper arm 12 is pivotally connected to the sidewall 112 via the second support rivet 119 that inserts into the third connecting hole 114. The load rest 120 of the support 100 is pivotably connected to the bracket 110 via the first connecting hole 111.

Figure 4:
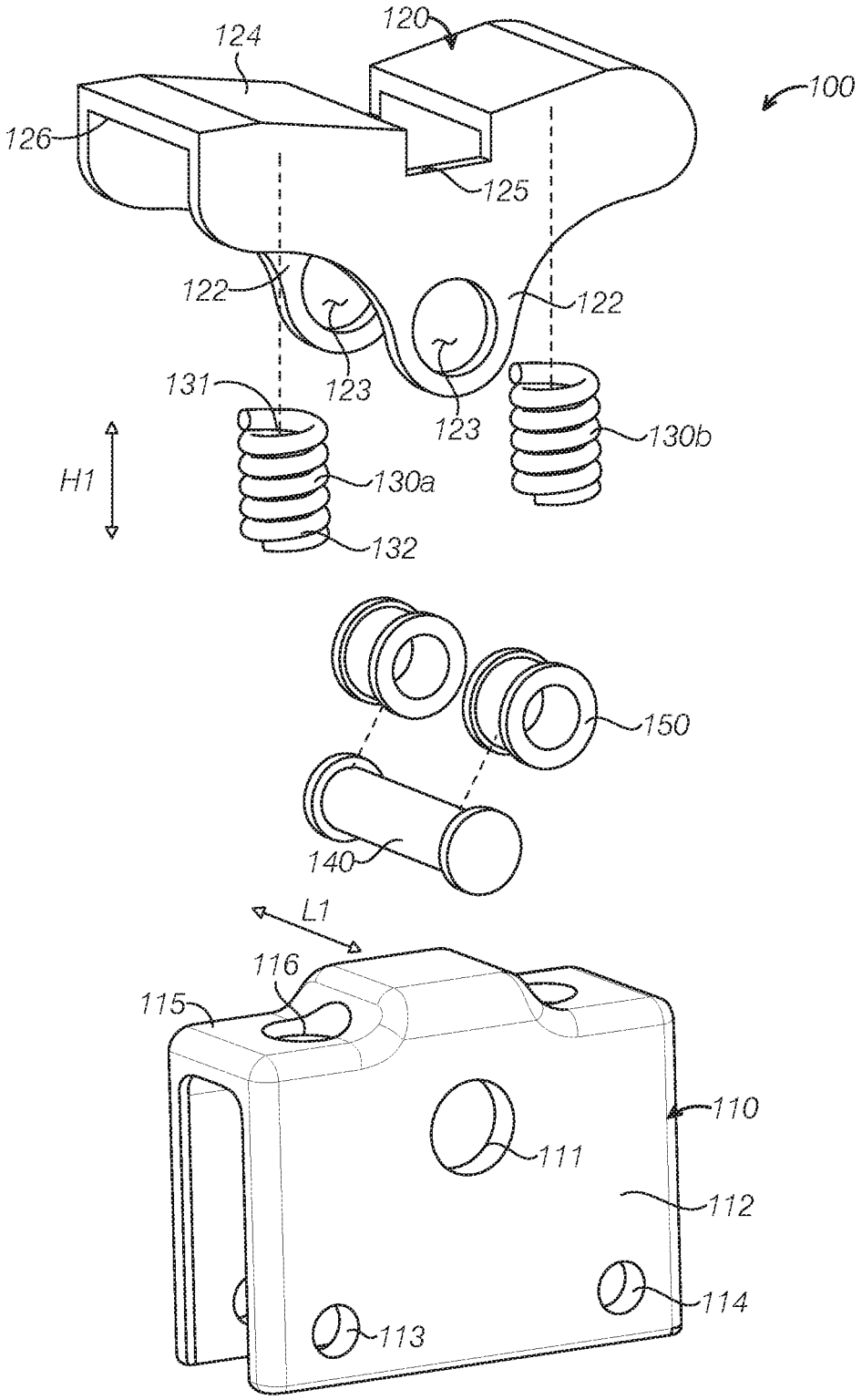
FIG. 4 is an exploded view of a scissor jack according to one or more embodiments of the present disclosure.

Continuing FIGS. 2A and 2B and with further reference to FIG. 1 and FIG. 4, the load rest 120 has a supporting plane P. As shown in FIG. 1, when the jack 10 is at an unloaded position, the supporting plane P of the load rest 120 is substantially parallel with the driving rod 18 or the ground. The load rest 120 includes a main body 127 and a pair of sidewalls 122 extending downward from the main body 127. The main body 127 includes an upper support surface 124 to contact a bottom surface of a lifted object (such as a vehicle) and a lower surface 126 facing a top surface 115 of the bracket 110 and being connected to an elastic member 130.

Figure 3:
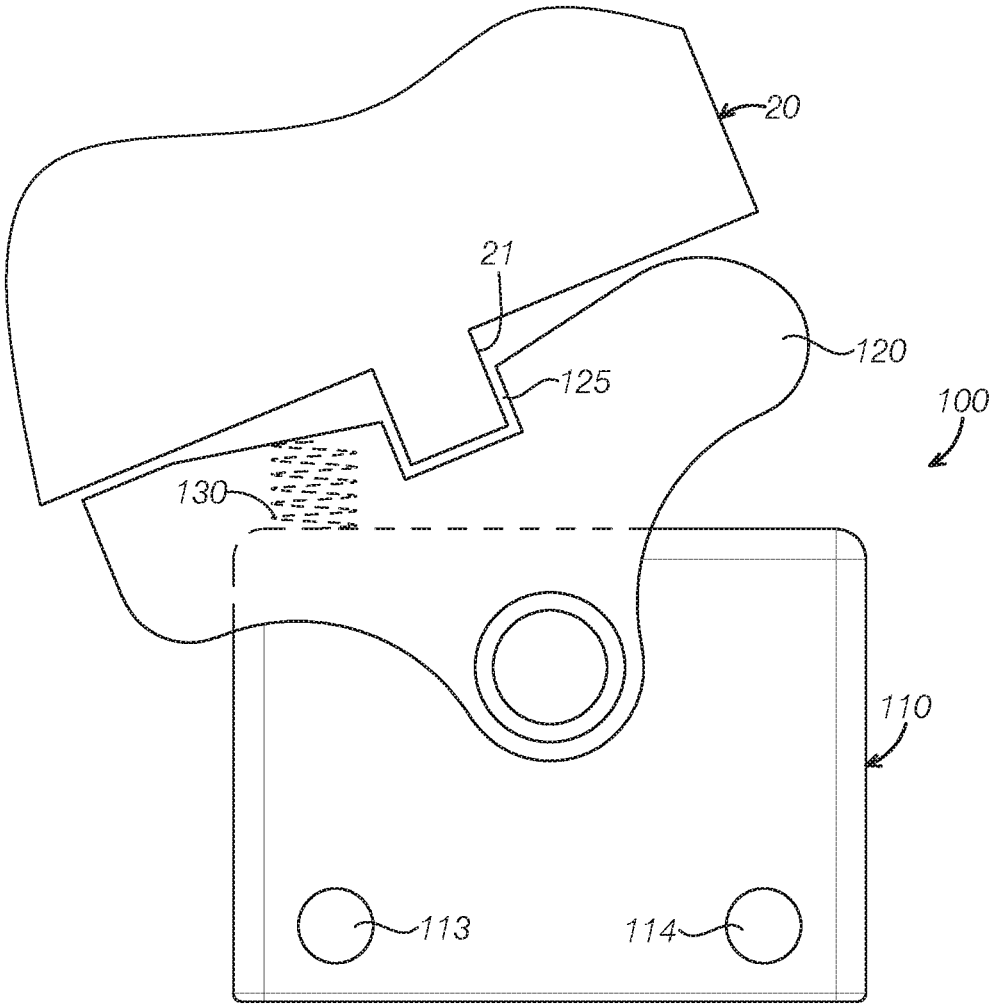
FIG. 3 is a front view of the support in FIG. 2A, illustrating the support of the jack at a loaded position.

In some embodiments, the upper support surface 124 may be substantially parallels with the support plane P. in some embodiments, the upper surface 124 can be formed with other profiles, such as a surface having a slope or arc profile, concave or convex surfaces, or step profile. In some embodiments, the upper support surface 124 may have a slanted surface sloping toward to a center of load rest 120 as shown in FIG. 2A. Referring to FIGS. 2A and 3, in some embodiments, the upper support surface 124 may include a groove to receive a flange 21 on a bottom of the vehicle. When the load rest 100 of the jack 10 is at the unloaded position, the support plane P may be substantially parallel with the driving rod 18 regardless of the configures of the supporting surface 124.

Referring to FIG. 4, in some embodiments, the sidewall 122 of the load rest 120 may be configured to receive a portion of the bracket 110. That is, the bracket 110 is positioned between the two sidewalls 122 of the load rest 120 to have robust connection. Each of the sidewall 122 may has a hole 123 for the pivot pin 140 to pass through. In some embodiments, the support 100 may further include a damping ring 150. The damping ring 150 may be made from a flexible material such as Polyoxymethylene (POM). In the embodiments shown in FIG. 4, the support 100 includes two damping rings 150. The damping rings 150 are positioned at two ends of the pivot pin 140, pass through the hole 123 and the first connection hole 111, and cover at least a portion on the pivot pin 140. In this way, when the load rest 120 rotates relative to the bracket 110, wearing and noise between the parts can be minimized or reduced.

Referring to FIGS. 1 and 4, in some embodiments, the lengthwise direction L1 of the pivot pin 140 is substantially perpendicular to the lengthwise direction L2 of the driving rod 18. In the depicted embodiment, the bracket 110 is positioned between pair of the sidewalls 122 of the load rest 120 and is further positioned between the sidewalls 19, 20 of the first arm 11 and the sidewalls 21, 22 of the second arm 12. Therefore, the bracket 110 has a stable structure.

Further, in the depicted embodiment, the first connection hole 111 of the bracket 110 is positioned between second connection hole 113 and the third connection hole 114 along the lengthwise direction L2 of the driving rod 18 and is offset from a connection line of the second connection hole 113 and the third connection hole 114. That is, the three connection points of the bracket 110 with the load rest 120, the first arm 11 and the second arm 12 of the jack 10 constitutes a plane to form a stable connection and thus achieve robust connection of the load rest 120 relative to other components of the jack 10. In addition, such structure is steady and can reduce or eliminate a force applied on the side of the jack 10 at the use condition.

Continuing with FIGS. 2A and 2B and with further reference to FIG. 4, the support 100 may further include an elastic element 130. The elastic element 130 is positioned between the load rest 120 and the bracket 110. In the depicted embodiment, the elastic element 130 has a first end 131 connected to a lower surface 126 of the load rest 120, and a second end 132 connected to an upper surface 115 of the bracket 110. In some embodiments, the lower surface of the load rest 120 may include a first groove 127 to receive the first end 131 of the elastic element 130. Similarly, the upper surface 115 of the bracket 110 may include a second groove 116 to receive the second end 132 of the elastic element 130. Thus, the elastic element 130 is secured with the bracket 110 and load rest 120. Alternatively, the first end 130 and the second end 131 of elastic element 130 may be connected with the bracket 110 and the load rest 120 via other appropriate connections such as adhesive connection, snap fit, welding, and vulcanization.

Continuing with FIGS. 2A and 2B, the elastic element 130 may extend along a direction H substantially perpendicularly to the lengthwise direction L1 of the pivot pin 140, and is configured to counteract a pivotal movement of the load rest 120 relative to the bracket 110 from an unloaded position. With proper selection of a length, an elastic coefficient, or a position of the elastic element 130, a desired bias force to restore the load rest 120 to its unloaded position can be achieved. In some embodiments, the support plane P of the load rest 120 may be substantially parallel to the driving rod 10 or the ground under the unloaded position. In the embodiments illustrated in FIGS. 2A and 2B, the elastic element 130 include one elastic member and is disposed at one side of the load rest 120 and the bracket 110. That is, the elastic element 130 is positioned away from a center of the load rest 120 or a center of the bracket 110.

Referring to FIG. 4, in some embodiments, the elastic element 130 may include a first elastic member 130*a* and a second elastic member 130*b*. The first elastic member 130*a* and the second elastic member 130*b* are disposed at opposite sides or left and right sides of the pivot pin 140 along the lengthwise direction L2 of the driving rod 140. In other words, the pivot pin 140 is located at the middle portion of a main body 127 of the load rest 120 while two elastic members 130*a* and 130*b* are positioned at the two sides of the main body 127, respectively. Under collective action of both elastic members, the load rest 120 is biased toward the unloaded position. Such structure is advantageous in providing a balanced force to the load rest 120 no matter how the jack is positioned relative to the lifted object such as a vehicle. It should be appreciated that it is possible to use one or more elastic members in the jack depending on the needs.

For the purpose of the illustration, the elastic element 130 is shown as a coil spring. In some embodiments, the elastic member may have other configurations such as a rubber rod, a sheet spring. The elastic element 130 may have a predetermined elastic coefficient, for example in a range of 2.5 kN/mm to 4.5 kN/mm. A greater bias force can be achieved by using an elastic element with greater elastic coefficient.

The load rest 120 is pivotably connected with the bracket 110 via the pivot pin 140 positioned in the hole 123 on the load rest 120 and the first connecting hole 111 on the bracket 110. When a lateral force is applied on the support 100 of the jack 10, the load rest 120 will rotate relative to bracket 110. Thus, the effect of the lateral force generated due to the lateral movement of lifted object can be reduced. Further, the lateral force can be prevented to transfer to other parts of the jack 10 such as the base 13, the first lower arm 14, the second lower arm 15, the first upper arm 11, or the second upper arm 12.

Referring to FIG. 3, the lifted object 20 may be tilted toward the left and result in a lateral movement with the lifting of the support 100. Due to the pivotal connection of the load rest 120 with bracket 110, the load rest 120 will rotate counterclockwise relative to the bracket 110, and thus minimize a lateral loading. Meanwhile, the elastic element 130 is compressed, which provides an opposite upward force to stabilize the load rest 120 and reduce a downward angle. It should be understood that the rotated angle of the lifted object 20 and the load rest 120 are exaggerated for the illustration purpose in FIG. 3. The angle may be small in the actual application.

The scissor jack of the present disclosure comprises a load rest rotatably connected with a bracket. With the movement of the load rest relative to the bracket, the lateral forces resulted from the lateral movement of the lifted object to the jack can be reduced or eliminated. Thus, wearing of the jack can be prevented or reduced. Further, the bracket provides robust connection with the load rest and the upper arms of the jack and thus support of the scissor jack has a stable structure.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions.

It will be appreciated that the configurations and routines disclosed herein are exemplary in nature, and that these specific embodiments are not to be considered in a limiting sense, because numerous variations are possible.

The following claims particularly point out certain combinations and subcombinations regarded as novel and non-obvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

The invention claimed is:

1. A scissor jack, comprising:

a bracket pivotally connected to a first upper arm and a second upper arm;

a load rest positioned above the bracket and pivotally connected to the bracket via a pivot pin;

an elastic element disposed between the load rest and the bracket;

a base coupled to a first lower arm and a second lower arm;

a first connector pivotally connected to the first upper arm and the first lower arm;

a second connector pivotally connected to the second upper arm and the second lower arm; and a driving rod drivably connected to the first and second connectors.

2. The scissor jack of claim 1, wherein a lengthwise direction of the pivot pin is substantially perpendicular to a lengthwise direction of the driving rod.

3. The scissor jack of claim 1, wherein each of two sidewalls of the load rest has a through hole, each of two sidewalls of the bracket has a first connecting hole, the pivot pin passes through the through holes and the first connecting holes such that the load rest is pivotable via the pivot pin relative to the bracket.

4. The scissor jack of claim 3, further comprising a damping ring disposed between the pivot pin and the first connecting hole.

5. The scissor jack of claim 3, wherein each of the two sidewalls of the bracket includes a second connecting hole and a third connecting hole, the first connecting hole is disposed between the second and third connecting holes at a lengthwise direction of the driving rod, wherein the bracket is pivotally connected to the first and second upper arms via a first support rivet positioned in the second connecting hole and a second support rivet positioned in the third connecting hole, respectively.

6. The scissor jack of claim 1, wherein a lengthwise direction of the elastic element is substantially perpendicular to a lengthwise direction of the pivot pin.

7. The scissor jack of claim 6, wherein the elastic element includes two elastic members and the pivot pin is between the two elastic members at a lengthwise direction of the driving rod.

8. The scissor jack of claim 6, wherein the elastic element is configured to bias the load rest toward an unloaded position, and a support plane of the load rest is substantially parallel to the driving rod at the unloaded position.

9. The scissor jack of claim 8, wherein a lower surface of the load rest includes a first groove to receive a first end of the elastic element, and a top surface of the bracket includes a second groove to receive a second end of the elastic element, and the elastic element is connected to the load rest and the bracket.

10. The scissor jack of claim 6, wherein the elastic element is a coil spring.

11. The scissor jack of claim 10, wherein the coil spring has an elastic coefficient in a range of 2.5 to 4.5 kN/mm.

12. The scissor jack of claim 6, wherein the elastic element is a rubber rod.

13. The scissor jack of claim 1, wherein the base is pivotally connected to the first lower arm via a first base rivet and pivotally connected to the second lower arm via a second base rivet.

14. A scissor jack, comprising:

a pair of upper arms;

a driving rod at least partially positioned between the pair of upper arms;

a support including:

a bracket pivotally connected to the pair of upper arms, a load rest disposed above the bracket to hold an object, wherein the load rest is pivotally connected to the bracket via a pivot pin and pivoted around the pivot pin to at least partially offset a lateral force applied by the object, and an elastic element, wherein the elastic element is connected between the bracket and the load rest and configured to bias the load rest toward an unloaded position, and wherein the load rest has a support plane, the support plane is substantially parallel the driving rod at the unloaded position and contacts the object at least partially at a loaded position.

15. The scissor jack of claim 14, wherein the bracket has two sidewalls substantially perpendicular to the support plane of the load rest, each of the sidewalls include a first connecting hole, a second connecting hole and a third connecting hole, the second and third connecting holes are positioned at left and right sides of the first connecting hole, respectively and wherein the bracket is pivotally connected to the first and second upper arms respectively via a first support rivet in the second connecting hole and a second support rivet in the third connecting hole.

16. The scissor jack of claim 14, further comprising a pair of lower arms and a base pivotally connected to the pair of lower arms.

17. A support of a scissor jack, comprising:

a bracket including sidewalls pivotally connected to a pair of upper arms of the scissor jack;

a load rest, wherein the load rest is positioned above the bracket, includes a main body to support an object and sidewalls extending down from the main body, wherein the sidewalls of the load rest is pivotally connected to the sidewalls of the bracket via a pivot pin, and a lengthwise direct of the pivot pin is substantially parallel to a pivot axis around which the bracket pivotable to the upper arms; and an elastic element, wherein one end of the elastic element is connected to a lower surface of the main body of the load rest, and another end is connected to a top surface of the bracket.

18. The support of claim 17, wherein the elastic element is configured to counteract a pivotal movement of the load rest.

19. The support of claim 17, wherein the elastic element is positioned above and to one side of the pivot pin.

20. The support of claim 17, wherein the pivot pin is positioned between a center area of the main body of the load rest, the elastic element includes two elastic members, the two elastic members are positioned on opposite sides of the pivot pin at a lengthwise direction of a driving rod.

* * * * *